United States Patent [19]

Choi

[11] Patent Number: 4,619,125

[45] Date of Patent: Oct. 28, 1986

[54] KEY HOLDER WITH CHANGEABLE INDICIA DISPLAY

[76] Inventor: Won H. Choi, 43 W. 27th St., New York, N.Y. 10001

[21] Appl. No.: 628,472

[22] Filed: Jul. 6, 1984

[51] Int. Cl.[4] ..... E05B 19/24

[52] U.S. Cl. ..... 70/460; 24/163 K; 40/618

[58] Field of Search ..... 70/456 R, 459, 460; 40/618, 2 A, 1 G; 24/3 K, 163 K; 211/94

[56] References Cited

U.S. PATENT DOCUMENTS

| | | | |
|---|---|---|---|
| 490,687 | 1/1893 | Smith | 40/16 |
| 1,395,621 | 11/1921 | Wheatley | 40/618 |
| 2,195,042 | 3/1940 | Wishinsky | 40/2 A |
| 2,430,914 | 11/1947 | Ciani | 70/411 |
| 2,640,347 | 6/1953 | Majeski | 70/456 R |
| 2,976,630 | 3/1961 | Montfort | 40/2 A |
| 3,335,509 | 8/1967 | Braxton | 40/16 X |
| 3,829,994 | 8/1974 | Dillon | 40/2 A |
| 4,271,352 | 6/1981 | Thomas | 40/2 A X |

FOREIGN PATENT DOCUMENTS

| | | | |
|---|---|---|---|
| 1249289 | 11/1960 | France | 40/2 A |
| 1412245 | 4/1965 | France | 40/2 A |
| 1497493 | 9/1967 | France | 40/2 A |
| 1507432 | 11/1967 | France | 40/2 A |
| 475488 | 10/1952 | Italy | 40/16 |
| 85244 | 3/1955 | Norway | 70/460 |
| WO79/01032 | 11/1979 | PCT Int'l Appl. | 40/16 |
| 354634 | 8/1931 | United Kingdom | 40/2 A |
| 2093340 | 9/1982 | United Kingdom | 70/456 R |

*Primary Examiner*—Robert L. Wolfe
*Assistant Examiner*—Lloyd A. Gall
*Attorney, Agent, or Firm*—Ralph S. Turoff

[57] ABSTRACT

A key holder having a main body portion with an eyelet-like extension extending from one end thereof through which a chain or other element can be inserted to support one or more objects such as keys and the like and wherein an elongated channel is provided in the body portion extending along a substantial length of the body but terminating from the edge thereof adjacent the eyelet portion in which channel a plurality of individual indicia bearing slide elements may be selectively received and locked therein by means of an adjustable locking member.

6 Claims, 11 Drawing Figures

KEY HOLDER WITH CHANGEABLE INDICIA DISPLAY

BACKGROUND OF THE INVENTION

1. Field of the Invention

This invention is generally directed to key holders and the like and specifically to key holders having a main body portion including a channel therein in which any of a plurality of indicia bearing slide members may be selectively received in order to alter the display characteristics of the holder and wherein such slide elements are retained in secured engagement with the main portion of the holder by separate mechanical locking means such as a threaded locking member.

2. History of the Prior Art

There are numerous key holders for use in supporting keys and the like. Such key holders provide a broad base or support from which the keys or similar elements may be suspended and thereby provide a means for more easily manipulating the keys when placing them in or withdrawing them from a user's pocket. The key holders also have utility in providing a means for identifying the key as belonging to a particular person or establishment. In this regard, many key holders have various indicia printed thereon to indicate the ownership or other information relating to the specific key.

In some prior art key holders, the indicia may be placed directly on the main body of the key holder by stamping letters or symbols on the face of a plastic metal or leather material. Such key holders have the disadvantage that they are specifically constructed for use in identifying only a particular key or similar element.

In other types of key holders, transparent housings are provided in which various card carrying indicia may be inserted and retained. These card carrying type key holders permit the information carried by the key holder to be selectively changed so that the key holder is not restricted for use with a particular set of keys or other items. In many of the key holders using a slidable card carrying indicia, the key holder is subject to a heat process after the indicia has been placed therein to seal the card element and prevent its withdrawal. In other key elements, the card element is simply inserted within an elongated groove or opening within the key holder and is therefore subject to becoming dislodged or accidently removed therefrom.

Still other prior art key holders have been manufactured using sectionalized body portions which are pivotally joined and may include integrally formed locking portions. Such sectionalized key holders are not only more complicated in construction but the pivotal elements which are often constructed of a plastic material can become worn over time causing the key holder to fail at the point of the pivot movement between the parts. Furthermore, the locking elements of such sectionalized key holders are often provided by means of small enlargements or frictional locking tab portions provided on one element which are engaged within a recess on a separate portion. Such interlocking elements are frequently subject to wear over a period of time and may be separated from one another by the application of manual pressure being exerted between the component parts.

Therefore, with prior art key holders, it is not possible to freely exchange the indicia carried by the key holder in order to provide either personalized identification of the key holder or to otherwise change the indicia to create a different visual display or alter some advertising material or other statement while simultaneously providing means for securely retaining such changeable indicia within the key holder.

SUMMARY OF THE INVENTION

This invention is directed to key holders and similar article carriers including a main body portion having a pair of grooved channel means formed therein in opposing relationship with one another in which channel means a plurality of individual slide members carrying separately displayed indicia thereon may be selectively received. Such slide members have a flange portion on each end thereof which interlocks or keys such slide members within the opposing channels of the main body portion so that such members may not be accidently removed therefrom but are restricted in their movement to a selective reorientation along the length of the opposing channels. The slide members are retained in position by providing threaded locking members which engage the outermost most slide member and retain the same in fixed relationship with a portion of the body of the key holder to thereby prevent the withdrawal of such slide member. By selectively manipulating the threaded locking members, the end slide member may be removed thereafter permitting the interchange and/or removal of the remaining slide members retained by the key holder.

It is a primary object of this invention to provide a key holder having a plurality of interchangeable and separate slide members which may be inserted and retained therein to selectively change the visual display or other information carried by the holder.

It is yet another object of this invention to provide a key holder wherein the body of the key holder includes a pair of opposing channels in which separate slide members may be easily and readily inserted and wherein such slide members are prevented from accidental displacement by positive locking means which engages at least one of the slide members in a threaded locking engagement with the body portion of the holder.

DESCRIPTION OF THE PREFERRED EMBODIMENT

Figure 1:
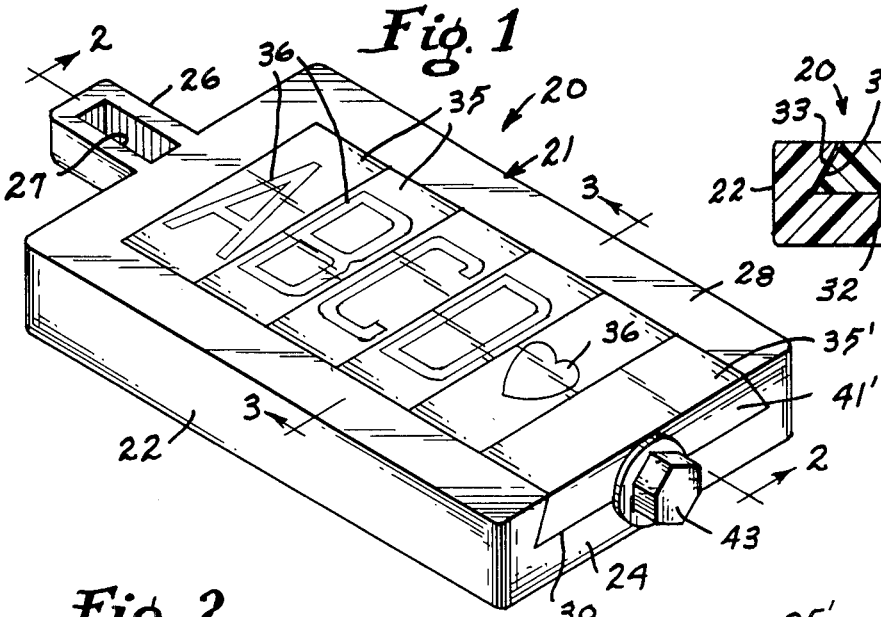
FIG. 1 is a perspective view of a preferred embodiment of the invention showing a plurality of slide members secured within the key holder element.
Figure 3:
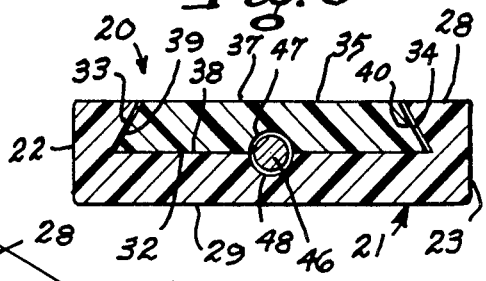
FIG. 3 is a cross-sectional view taken along lines 3—3 of FIG. 1.
Figure 2:
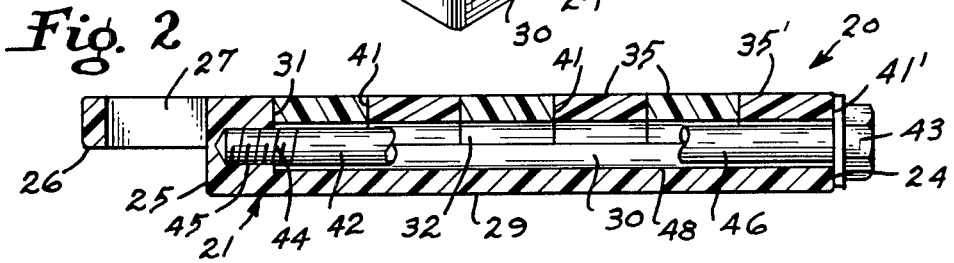
FIG. 2 is a cross-sectional view taken along lines 2—2 of FIG. 1.

With continued reference to the drawings, a preferred form of key holder 20 of the present invention is shown in FIGS. 1–3 as including a generally rectangular body portion 21 having generally elongated side walls 22 and 23 and end walls 24 and 25. A generally U-shaped eyelet portion 26 is shown as being integrally formed and extending from the end wall 25 so as to define an opening 27 therethrough through which a chain, snap ring or other key supporting member may be selectively extended. The integral body portion 21 is further defined having a generally U-shaped upper surface 28 and a generally continuous rectangular lower surface 29.

In order that various information, advertising or other symbols may be carried by the key holder of the present invention, an elongated channel 30 is formed within the body portion 21 and extends from the end wall 24 to an inner wall 31 which is spaced inwardly from the opposite end wall 25 of the holder. The elongated channel 30 is defined by a generally planar intermediate wall portion 32 which extends generally parallel with the upper and lower surfaces 28 and 29 of the key holder. The sides of the channel are defined by guide wall portions 33 and 34 which extend from the intermediate wall portion 32 upwardly and inwardly towards the upper surface 28 of the key holder. In this manner a pair of generally V-shaped guide slots or guide grooves are formed in opposing relationship within the body of the key holder.

A plurality of slide members 35 are cooperatively received and movable along and within the channel 30 formed within the body of the key holder. A number of slide members 35 may carry varying indicia such as shown at 36 in FIG. 1. The slide members are generally trapezoidal in shape, as shown in cross section of FIG. 3, having generally parallel upper and lower planar surfaces 37 and 38 and inwardly tapering side wall portions 39 and 40 which extend generally parallel to the inwardly tapering side walls 33 and 34 defining the edges of the channel 30 within the body of the key holder.

With particular reference to FIG. 2, the side walls 41 of each of the slide members 35 are substantially planar so that each of the slide members abuts an adjacent slide member in side by side relationship within the body of the key holder. In order to secure the slide members within the channel 30, an elongated screw member 42 extends along the length of the key holder with the enlarged head portion 43 thereof simultaneously engaging the end wall 24 of the key holder and the outer side wall 41' of the end or last slide member 35'. Remote from the enlarged head portion 43 of the elongated screw member 42 is a threaded end portion 44 which is cooperatively received in a threaded opening 45 formed within the body of the key holder and extending from the inner wall 31 towards the outer wall 25 thereof.

Figure 4:
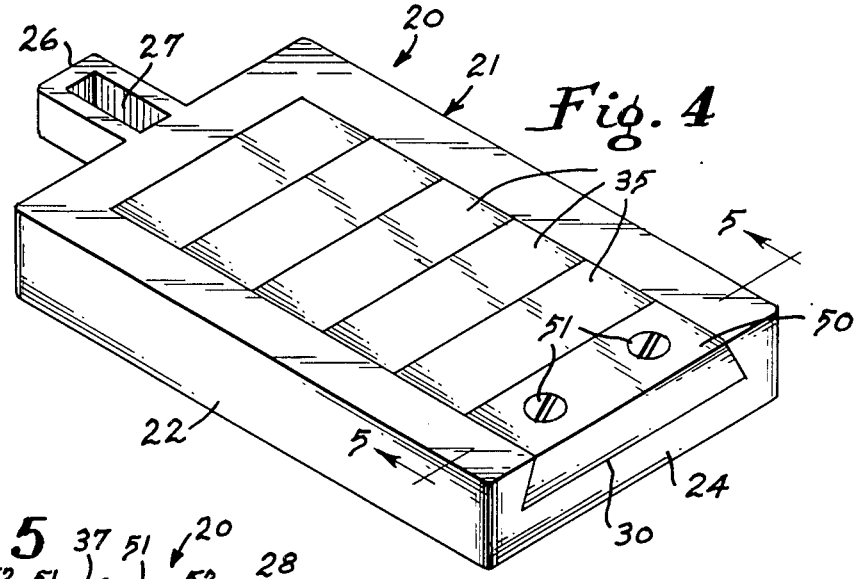
FIG. 4 is an alternate embodiment of the invention showing in an alternate locking engagement.

As is shown in FIGS. 3 and 4, in order to permit clearance for the shank portion 46 of the elongated screw member 42 to pass between slide members 35 and the body portion of the key holder, an elongated cylindrical opening is formed between the slide members and the wall portion 32 of the body of the key holder through which the screw threaded member may be selectively extended. As shown in FIG. 3, each of the slide members includes a semicircular groove 47 formed in the lower wall portion 38 thereof which is cooperatively aligned, when the slide members are placed within the groove 30, with a semicircular groove 48 formed in the central portion of the intermediate wall portion 32 defining the groove 30.

Although the key holder of the present invention may be made of any number of materials, it is envisioned that the body portion thereof would generally be formed of a moldable plastic material which may include an acrylic plastic. The slide members may also be formed of any desired material but are also generally preferably formed from a moldable plastic material. The indicia may either be printed on, molded into, stamped or otherwise applied to or formed with the slide members.

In use of the key holder of the preferred embodiment, each of the slide members 35 may have varying types of indicia 36 displayed thereon. Such indicia may take the form of designs, addresses, advertising, names, symbols and the like with the amount of such indicia varying from slide member to slide member. As is noted in FIG. 1, some slide members such as the end slide member 35' may be free of any indicia material so as to provide a function as a spacer element between other indicia. When it is desired to change the indicia of the key holder, the enlarged head 43 of the elongated screw member is rotated so as to remove the elongated screw member from threaded engagement with the threaded opening 45 formed in the body of the key holder. Thereafter the elongated screw member is pulled longitudinally with respect to the key holder thereby permitting each of the slide members to be moved along the channel 30 and freed from engagement with the key holder.

After a preselected number of indicia bearing slide members are repositioned within the groove 30 of the key holder, the elongated screw member is again inserted between the slide members and the semicircular groove 48 formed in the wall 32 defining the channel 30 and brought into threaded engagement with threaded opening 45 within the end portion of the key holder.

Figure 5:
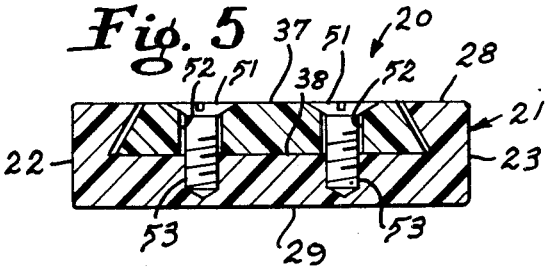
FIG. 5 is a cross-sectional illustration taken along lines 5—5 of FIG. 4.

A second embodiment of the invention is disclosed in FIGS. 4 and 5. In this embodiment, the structure of the body portion 21 of the key holder remains substantially the same as that of the preferred embodiment. The difference in this embodiment is in the manner in which the slide members 35 are secured within the channel 30 of the key holder. Specifically, instead of utilizing an elongated screw threaded member such as shown at 42 in FIGS. 1–3, the end or last slide member designated as 50 in FIG. 4, is directly secured to the body portion of the key holder by a pair of screw members 51 which are mounted through countersunk openings 52 which extend through the slider member 50 from the top 37 to the bottom 38 thereof and which align with threaded openings 53 formed through the intermediate wall portion 32 and into the body of the key holder.

In use of the embodiment of the invention shown in FIGS. 4 and 5, after a preselected number of indicia bearing slide members 35 are positioned within the channel 30 of the key holder, the last slide member 50 having the countersunk openings 52 therein is positioned so as to be generally flush with the end wall 24 of the key holder. Thereafter the screw threaded members 51 are threadingly engaged through the countersunk openings 42 with the threaded openings 53 within the key holder body.

Figure 6:
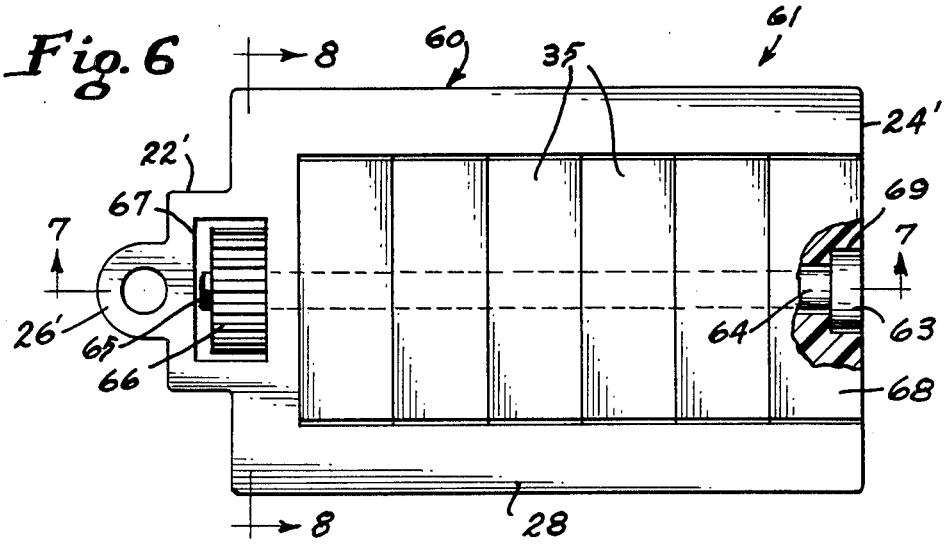
FIG. 6 is yet another embodiment of the invention showing a top plan view having portions broken away.
Figure 7:
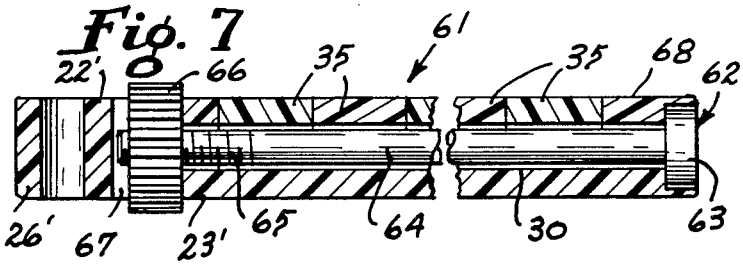
FIG. 7 is a cross-sectional view taken along lines 7—7 of FIG. 6.
Figure 8:
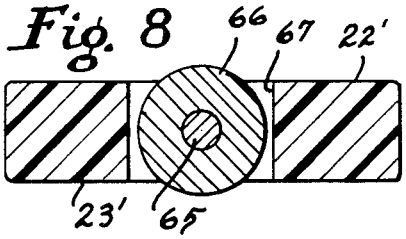
FIG. 8 is a cross-sectional view taken along lines 8—8 of FIG. 6.

Another embodiment of the present invention is shown in FIGS. 6–8 of the drawings. In this embodiment, the slide members 35 are generally formed substantially as shown in FIGS. 1–3 having a trapezoidal cross section so that the slide members 35 may be movably engaged between the generally opposing V-shaped grooves created by the elongated channel 30 within the body portion of the key holder.

In this embodiment, the body portion 60 of the key holder 61 is shown as having adjustable securing member 62 for locking the slide members 35 in an abutting engagement within the channel 30 formed within the body portion 60 of the key holder. The adjustable locking means includes an elongated screw member having a head portion 63, intermediate shank portion 64, and a threaded end portion 65. The shank portion 64 extends between semicircular grooves within the slide members and body portion of the key holder in a manner similar to that shown in FIG. 3 with respect to the preferred embodiment.

In the present embodiment, however, the threaded end portion 65 of the securing member 62 is engaged by an adjusting nut 66 which is disposed within an opening 67 formed through the body portion 60 of the key holder adjacent the integrally formed eyelet portion 26'. The opening 67 extends completely through the body of the key holder from the upper surface 22' to the lower surface 23' thereof. It should be noted that the size of the opening 67 is somewhat larger than the nut 66 so that a limited amount of axial movement of the screw threaded member with respect to the nut is permitted within the opening.

In this embodiment, the end or last slide member 68 and a portion of the end wall 24' are modified to form a recess 69 in which the head 63 of the screw threaded member may be received when the screw threaded member is drawn into tight engagement with the end slide member by manipulation of the adjusting nut 66.

Figure 9:
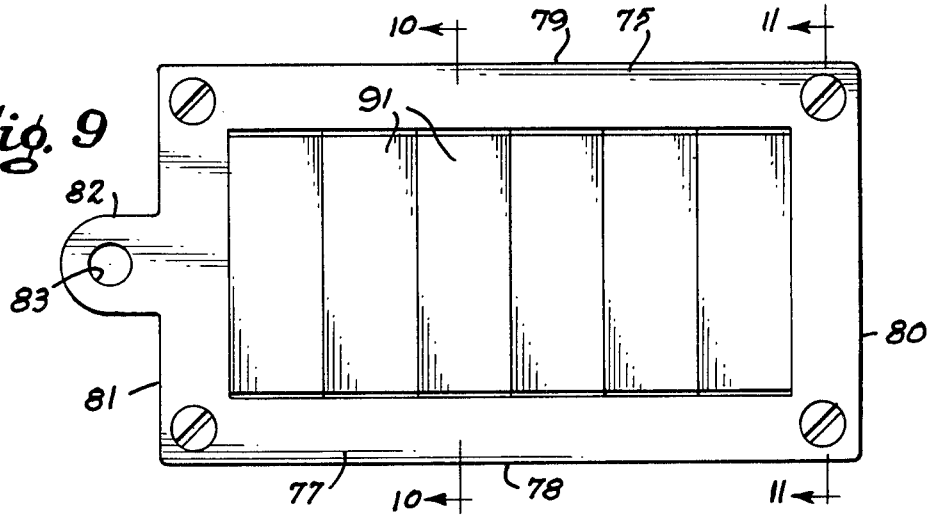
FIG. 9 is a further embodiment of the invention showing the key holder slide elements in top plan view.
Figure 10:
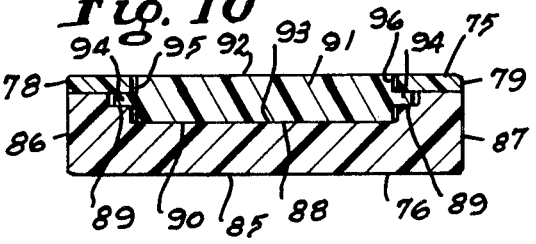
FIG. 10 is a cross-sectional view taken along lines 10—10 of FIG.
Figure 11:
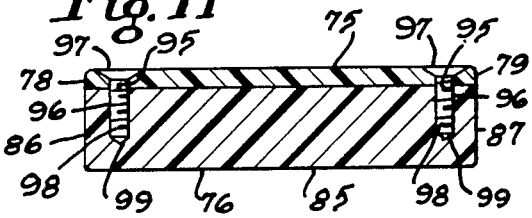
FIG. 11 is a cross-sectional view taken along lines 11—11 of FIG. 9.

Yet another form of the present invention is disclosed in FIGS. 9–11. In this embodiment, the body of the key holder is formed having upper and lower portions 75 and 76, respectively. The upper portion 75 is shown as being of a generally open rectangularly frame shape having an upper surface 77, side walls 78 and 79 and end walls 80 and 81. An eyelet portion 82 is integrally formed with the end wall 81 so as to define an opening 83 threrethrough through which a chain or other element may be selectively extended.

The lower portion 76 of the key holder is integrally formed in a generally rectangular shape having a bottom wall 85 and side walls 86 and 87. An enlarged recess 88 is formed within the lower portion of the body of the key holder and as shown in FIG. 10, the recess 88 is formed in a steplike configuration so as to create a pair of opposed generally L-shaped channel portions 89 which extend along the length of the key holder. The bottom of the recess is defined by inner planar wall portion 90. The slide elements 91 of the present embodiment are generally rectangular in cross section having upper and lower surfaces 92 and 93. Each slide element 91 also includes a pair of longitudinally extending flange members 94 which are oriented outwardly on either side 95 and 96 thereof. When the slide members are placed within the lower portion of the key holder, the flange portions 94 will rest within the L-shaped grooves 89 provided in the recess 90. Thereafter the upper portion of the body member is positioned in a framelike member above the flange portions 94 of the slide members with the side walls and end walls of the upper portion being aligned with the side and end walls of the lower portion.

In order to secure the framelike upper portion 75 to the lower portion of the key holder 76, a plurality of aligned openings 95 and 96 are made through the upper portion and lower portion of the body member as shown in FIGS. 9 and 11. The openings 95 may be countersunk so as to receive the enlarged head portions 97 of screws 98 which are disposed through the aligned openings. The openings 96 are threaded so as to cooperatively receive the threaded end portion 99 of the screws. As shown in the drawings, a screw is provided in each of the corners of the generally rectangular shaped key holder.

In the use of the present embodiment, when it is desired to change the slide members so as to display a different indicia on the key holder, the screws 98 are removed from the aligned openings within the upper and lower portions of the key holder and thereafter the upper portion is raised from engagement with the lower portion. The slide members may now be lifted from their engagement within the recess formed within the lower portion of the key holder. After new slide members have been positioned within the recess with their flange portions in engagement with the L-shaped channel 89, the upper portion 75 of the key holder is again brought into alignment and secured with the lower portion of the key holder thereby securing the slide members therebetween.

I claim:

1. A key holder apparatus comprising a body having upper and lower surfaces, first and second ends and side walls, means adjacent said first end for supporting a key from said body, a channel within said body, said channel having a pair of opposed guide walls within said body and between said upper and lower surfaces and extending from adjacent said first end thereof toward said second end, at least one slide means supported within said channel, locking means abutting at least one of said slide means for securing said slide means within said channel of said body, said locking means being selectively adjustable to permit said slide means to be removable from said body therefrom whereby preselected slide means may be selectively positioned and retained within said body of the key holder including a plurality of said slide means, at least one of said slide means having indicia displayed thereon, in which said locking means includes an elongated shaft means, said elongated shaft means having a screw threaded portion and a head portion, an elongated opening disposed between said slide means and said lower wall portion of said channel and extending from said second end towards said first end of said body, said elongated shaft means being selectively extended within said elongated opening.

2. The key holder apparatus of claim 1 in which said guide channel includes a generally planar lower wall portion and said guide walls taper inwardly with respect to one another, said slide means being generally trapezoidal in cross section having generally planar lower wall portions which are in slidable engagement with said lower wall portion of said channel, and said slide means having an upper surface with is generally coextensive with said upper surface of said body.

3. The key holder apparatus of claim 1 in which said locking means includes an adjusting nut, an opening through said body adjacent said first end thereof, said adjusting nut being disposed within said opening and engaging said screw threaded portion of said locking means.

4. The key holder apparatus of claim 3 in which said head portion of said elongated shaft means extends generally radially outwardly from said elongated shaft means, said head portion engaging said second end of said body and one of said slide means.

5. The key holder apparatus of claim 3 in which said elongated opening is formed by a semicircular groove in said lower wall portion of each of said slide means and a semicircular groove in said lower wall of said channel, said grooves being in opposing relationship with one another.

6. The key holder apparatus of claim 3 including a recess formed in said second end of said body and one of said slide means, said head portion of said locking means being receivable within said recess.

* * * * *